United States Patent [19]

Shore

[11] 4,417,502

[45] Nov. 29, 1983

[54] LOAD SUPPORTING HYDRAULIC CIRCUIT WITH EMERGENCY AUTOMATIC LOAD RESTRAINT

[75] Inventor: Daniel B. Shore, Niles, Ill.

[73] Assignee: Dresser Industries, Inc., Dallas, Tex.

[21] Appl. No.: 273,876

[22] PCT Filed: Nov. 17, 1980

[86] PCT No.: PCT/US80/01552

§ 371 Date: Nov. 17, 1980

§ 102(e) Date: Nov. 17, 1980

[87] PCT Pub. No.: WO82/01749

PCT Pub. Date: May 27, 1982

[51] Int. Cl.[3] ..... F15B 11/08; F15B 13/042

[52] U.S. Cl. ..... 91/447; 91/445; 91/451; 91/452

[58] Field of Search ..... 91/433, 449, 468, 471, 91/450, 445, 447, 451, 452; 137/101, 117, 460, 486, 487, 493, 513.3, 513.5, 513.7; 37/DIG. 7

[56] References Cited

U.S. PATENT DOCUMENTS

| | | | |
|---|---|---|---|
| 3,448,685 | 6/1969 | Kroth | 137/101 |
| 3,906,840 | 9/1975 | Bianchetta et al. | 91/445 |
| 3,908,515 | 9/1975 | Johnson | 91/445 |
| 4,004,607 | 1/1977 | Freese | 137/486 |
| 4,063,489 | 12/1977 | Parquet et al. | 137/498 |
| 4,102,250 | 7/1978 | Schexnayder | 91/452 |
| 4,138,929 | 2/1979 | Peterson | 91/451 |

*Primary Examiner*—Robert E. Garrett
*Assistant Examiner*—Richard L. Klein
*Attorney, Agent, or Firm*—B. E. Deutsch

[57] ABSTRACT

A load supporting hydraulic system having main control valve provided with a load check valve and a vent valve; the load check valve, which has a hose connection to the main control valve, is operative to permit free flow of fluid from the control valve toward the load supporting chamber of the system and to block fluid flow from the load supporting chamber toward the control valve, whereas the vent valve is operative with the control valve to permit the load check valve to be opened by fluid pressure from the load supporting chamber to allow fluid flow therefrom thru the hose connection and control valve to drain. A cancelling valve is added to the system to override the vent valve upon failure of the hose connection and reblock fluid flow from the load supporting chamber toward the hose connection and control valve.

12 Claims, 6 Drawing Figures

FIG. 3
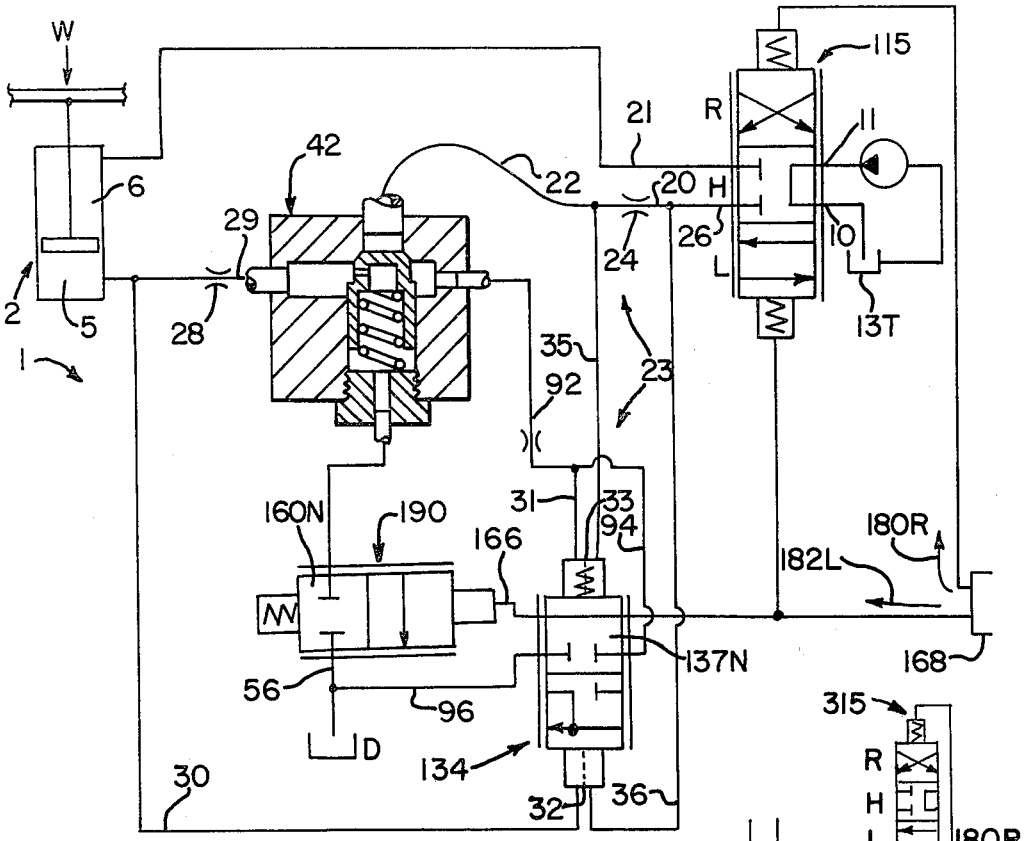
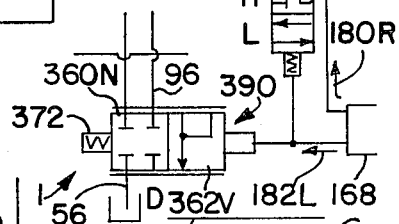
FIG. 6
FIG. 4
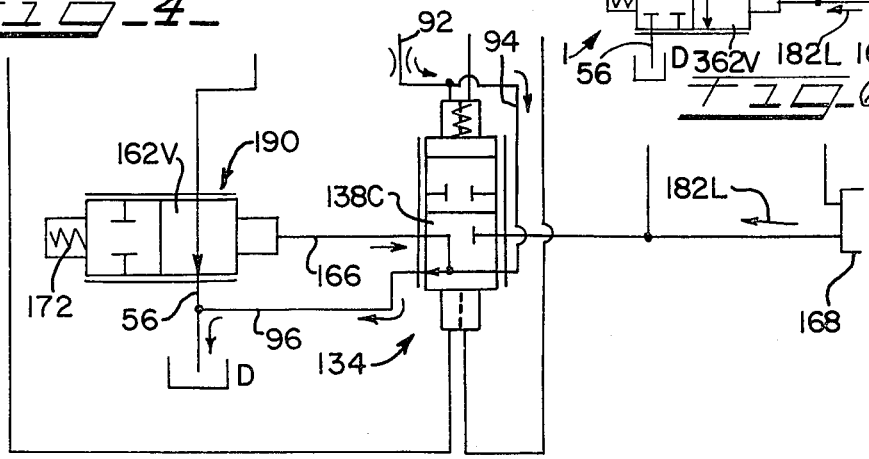

LOAD SUPPORTING HYDRAULIC CIRCUIT WITH EMERGENCY AUTOMATIC LOAD RESTRAINT

This application and expired U.S. Pat. No. 3,127,688 disclose differing respective improvements on an expired earlier U.S. Pat. No. 3,068,596.

Patents of only partial relevance because they do not address the hose line breakage problem include but are not limited to U.S. Pat. Nos. 3,805,678, 3,906,840, 4,006,667, 4,194,532 and 4,204,459. Another patent, U.S. Pat. No. 3,072,096, is included as a further background disclosure because of its relevance to preventing a cylinder from hydraulically dropping its load because of fluid line rupture.

The earlier expired U.S. Pat. No. ,068,596 relates to an hydraulic scraper-and-tractor combination wherein the hydraulic system for the scraper bowl is provided with two valves, one to prevent the existence of high pressure in the flexible conduit or hose which communicates between the controls on the tractor and the bowl actuating jacks when the weight of the bowl and its contents is imposed on the fluid in the system, and one to provide means under control of the tractor operator to enable quick lowering or dropping of the bowl when desired. One valve is a load locking check valve hydraulically disposed in posterior order with respect to the bowl actuating jack for affording free flow of fluid from the controls on the tractor to such jack and having a normal fluid blocking position for blocking flow of fluid from the jack back into the flexible hose going to the controls. What more particularly is disclosed is a load locking check valve having a control chamber which, when vented, effects opening of the check valve to afford flow of fluid from the load supporting chamber into and through the flexible hose and which includes restriction means in communication with the load supporting chamber, and the check valve being responsive to fluid pressure in the load supporting chamber to bias the check valve to its fluid blocking position to block fluid delivered by the check valve into the flexible hose for stopping flow from the jack to the controls on the tractor.

The other valve according to the patent disclosure is hydraulically disposed in anterior order with respect to the jack and serves as a quick-drop valve in lowering the scraper bowl by hydraulically short circuiting the rod end of the jack to empty directly into the head end thus preventing evacuation of the head end of the jack during bowl lowering.

The referred to expired improvement patent U.S. Pat. No. 3,127,688 is a disclosure to prevent the load from losing its supporting pressure from hydraulic short circuiting of the jack in event a quick drop hose connected to depressurize the valve for quick drop springs a leak or fails so as unwantedly to actuate the quick drop valve. Oversimplified, the patent teaches that reversing the order of the two halves so that the check valve is anterior and the quick drop valve is posterior with respect to the jack will safeguard against loss of load with quick drop hose failure. In other words, it can never be because of leakage or breaking of the quick drop hose that the scraper bowl will be accidentally dropped, because the anterior load check valve will be serving in its normally closed condition according to the patent to prevent flow of fluid short circuiting through the quick drop valve from the rod end to the head end of the jack.

As its distinction, the instant invention prevents loss of the load in event that other flexible hose, viz., the one communicating from the tractor controls via the load lock valve to the head end of the jack, itself springs a leak or fails; this invention for purposes of the present discussion is not confronted with the quick drop hose problem or with other unwanted depressurization of a quick drop valve because the quick drop valve will be added here only as and if preferred and is in no way essential to a showing or an understanding hereof.

In its broader aspects, this invention contemplates any ways and means whatever of automatically sensing the flexible hose has leakage to the outside while the load lock valve upstream thereof is open, and any ways and means whatever of automatically closing the open load lock valve immediatly such leakage occurs.

However, more specifically, I provide cancelling means, for all venting of the lock valve chamber, having connections in the flexible hose concerned and reacting therewith to a flow characteristic attendant with hose rupture to override and cancel any venting of the chamber. In the preferred embodiments illustrated, flow sensitive orifices in the hose line connected just about immediately, if not immediately, upstream and downstream of the line provide the cancelling means with an override signal taking cognizance of hose line failure as attended by flow entering the line, much in excess of what transferred amount is being retained and carried all the way through, and properly delivered from, the failed line.

It is then an object of my invention to interpose a load locking check valve to be in anterior order, from a flexible hose and vehicle controls, with respect to a load supporting jack on the vehicle, thus preventing the weight of the load from imposing high fluid pressures in the flexible hose which might induce early failure.

It is another object to provide automatic cancellation of venting of such load locking check valve if, every precaution to the contrary notwithstanding, the flexible hose breaks anyway and attempts to empty out the jack through the otherwise open check valve. That is to say, there is no loss of load and, instead, the load is hydraulically locked elevated with respect to the ground below.

It is another object of my invention, in event of hose failure and consequent automatic hydraulic locking of the load elevated, not only to avoid uncontrolled descent of that load but also automatically, with vent cancelling, to bypass the check valve and failed hose to afford restricted, hydraulically controlled descent of the load so as to return slowly and come to rest safely on the ground.

It is also an object, in the failed mode just described, for the operator to be capable of manually overcontrolling the automatic slow descent by stopping and restarting the slow rate descent of the load at will.

Further features, objects, and advantages will either be specifically pointed out or become apparent when, for a better understanding of my invention, reference is made to the following description taken in conjunction with the accompanying drawings which show certain preferred embodiments thereof and in which:

FIG. 3 is a full diagram showing of a modification of the embodiment of FIG. 1;

FIG. 4 is a diagram of a number of the valves of FIG. 3, assuming their emergency operating positions; and FIGS. 5 and 6 are partial diagram showings of further modifications of the embodiment of FIG. 1.

Figure 1:
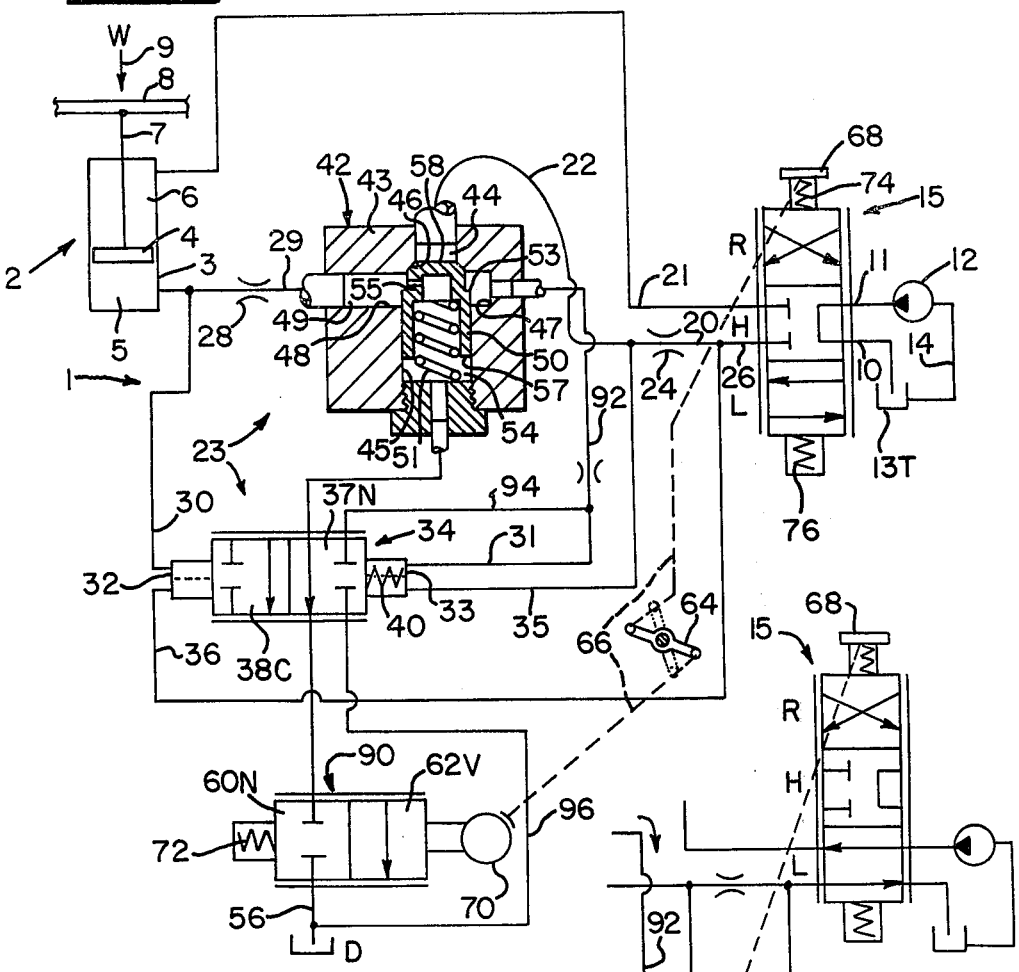
FIG. 1 is a schematic diagram of a load supporting, valved hydraulic control circuit embodying the principles of the present invention with the valves appearing according to standard symbols or depicted in longitudinal cross section as appropriate.

More particularly in FIG. 1 of the drawings, a valved fluid control system 1 is shown operatively connected to control a load supporting fluid motor 2. The motor includes a cylinder 3 having a piston 4 reciprocally mounted therein to define a load supporting chamber 5 at the head and a rod end chamber 6. A rod 7 has its inner end secured to the piston and extends outwardly of the cylinder. The head end of the motor 2 has a connection to a machine, not shown, with which the motor is equipped and at the outer end the rod 7 is connected to a boom, other type arm, or beam on the machine supporting a load W indicated by an arrow 9.

The load 9 is representative of a ground engaging tool such as an earthworking implement on the machine, especially vehicles such as hydraulic loaders and excavators and particularly the latter.

The system 1 includes two valve connections 10 and 11 serving as a source of pressure fluid supply and communicating with their supply system including a sump drain for connection 10 and a pump 12 which draws fluid from a sump or reservoir tank 13T through a suction line 14 for supply through the service connection 11 to a manual master directional control valve 15. The operator selectively positions the control valve 15 between a spring centered hold position H and either an upper appearing or raise operating position R or a bottom appearing or load lower operating position L of the valve 15.

The control valve 15 communicates with the load supporting or head end of the motor 2 by way of a service line 20 and with the opposite or rod end of the motor by way of a service line 21.

Although in practice it would not be the exclusive province for fluid line 20 to have it, FIG. 1 for the purposes here shows line 20 alone to have one or more curved sections indicative of including flexible rubber hose 22 therein. A break in such hose can mean no pressure left in line 20 and no more hydraulic support on the machine for an upraised load. Uncontrolled descent of the load produces different inadvertent movement and consequences in different machines, the same understood to be of generally known nature for each particular machine and to be avoided. I provide means of circuit switching having direct utility in that connection.

More particularly in regard to service line 20, I provide flow responsive mechanism generally indicated at 23 having a first orifice 24 interposed downstream at the valve connected end 26 of the flexible hose line 22 and a second orifice 28 interposed upstream in the load connected end 29 of the flexible line 22. Upstream sensing lines 30 and 31 communicate the pressure differential drop existing across orifice 28 to one side of opposing servo chambers 32 and 33 of a cancelling valve 34, and downstream sensing lines 35 and 36 communicate the pressure differential drop existing across the first orifice 24 to the other side of the opposing servo chambers 32 and 33. The cancelling valve 34 has a normal position 37N and a cancelling position 38C into which the chambers can force the valve against opposition of a spring 40 in chamber 33 tending to hold the valve in the normal position 37N.

A load check valve 42, such as the boom lock valve in my excavator applications, is connected in the service line 20 intermediate the head end of the motor and the control valve 15, being hydraulically interposed specifically at the load connected end 29 of the flexible line 22. The load check valve 42 is essential to the utility of the flow responsive mechanism 23.

Evan moreso, the load check valve 42 is of essential utility to the control valve 15. This latter utility is for the reason that when the load 9 is stopped in an elevated position such that it must be supported by the motor 2, fluid pressure in the end of the motor must be positively retained to avoid downward drift of the load due to leakage. Most control valves such as that schematically depicted at 15 are of the sliding spool type which necessarily include an annular clearance between the valve spool and the body to permit relatively free movement of the spool. This annular clearance permits leakage which is unacceptable in load supporting situations of this type, in that it permits downward drifting of the load as such leakage occurs.

In particular regarding the check valve 42 concerned, it includes a body 43 having a port 44 which communicates with a valve bore 45. The port 44 terminates at its inner end with a chamfered seat 46. An annular groove 47 is interposed at the inner ends of the port 44 and bore 45 for communication therewith and the groove further communicates through a passage 48 with a port 49. The port 44 is in communication with the control valve 15, whereas the port 49 communicates through orifice 28 in line 20 with the load supporting end of the motor 2.

A cup shaped element 50 of the valve 42 slides in the valve bore 45 and is biased by a spring 51 toward the port 44 for a sealing seated engagement with the seat 46. When the valve element 50 is seated as illustrated, it blocks communication between the ports 44 and 49 to isolate the load supporting high pressure of the motor from the control valve 15 to prevent leakage from the motor therethrough.

The cup shaped valve element 50 has a stepped outer diameter providing a shoulder 53 which affords a reduced end of the cup shaped valve element 50 and which is exposed to the load supporting pressure in the annular groove 47. The load supporting pressure acting on the shoulder 53 generates a valve opening force opposing the bias of the spring 51 and moves the check valve element off the chamfered seat 46. The valve bore 45 constitutes a vent or control chamber 54 which is behind the valve element 50 and which communicates restrictively through a wall orifice 55 in the reduced end of the element 50 with the annular groove 47. The orifice 55 is in constant registry or communication with such groove 47. So, load supporting pressure of the head end of the motor 2 assists the spring 51 in urging the check valve element toward a closed position inasmuch as the area of the check valve element exposed to the pressure in vent chamber 54 is greater than the cross sectional area of the shoulder 53.

The valved vent line 56 connected to vent chamber 54 is effective to relieve therefrom the pressure which, when relieved, allows the higher pressure acting on shoulder 53 to overcome the spring pressure, forcing the valve element 50 away from its seat 46 as will be explained below. In sum, a bottom end area 57 thereon ordinarily forces the valve element 50 upwardly in chamber 54 so as to seat itself, under rising pressure in chamber 54 whenever it is kept unvented by valved vent line 56 and is therefore pressurized by being fed through orifice 55. Or, the shoulder 53 under load pressure from motor 2 forces the valve element 50 downwardly in chamber 54 so as to unseat itself, under vented pressure in chamber 54 whenever it is vented by the valved vent line 56.

And, irrespective of the chamber 54 being vented or unvented, the pressure movable top end area 58 of valve element 50 forces it downwardly in chamber 54 so as to unseat itself, under rising load raise pressure fed into port 44; the reason is that the unseated valve element 50 when it unseats is hydrostatically balanced when the chamber 54 is unvented, and so raise pressure in port 44 must overcome only, and in fact readily overcomes, the lone spring 51 attempting to keep the valve element 50 seated.

A vent valve included in line 56 which is connected to drain D has a normal position 60N in the line which is closed and which establishes a valve-closed condition of the latter. The vented position thereof causing check valve opening is indicated at 62V. In other words, the check valve tries to follow, normally opening when the control valve 15 opens the vent valve, and normally closing when the control valve 15 closes the vent valve.

A motion reversing mechanism is illustrated at 64 schematically to have connections 66 to an operator's handle 68 on the control valve and to an actuator knob 70 on the vent valve; the reason is to have both valves operate in coordination when the operator positions manual control valve 15. Except for the broken line position shown for the mechanism 64, the mechanism 64 in all positions including its solid line position illustrated will not disturb the vent valve from its illustrated normal position 60N into which it is set by a vent valve spring 72. However, when the operator moves the control valve 15 into the load lower position L, the mechanism 64 is contemporaneously effective to establish the valve-open condition of the valved vent line 56; thus, normally the chamber 54 will be vented to allow the pressure movable shoulder 53 to hold the valve element 50 open while the load 9 is being lowered by the motor 2.

HOLD OPERATION H

A pair of opposed centering springs 74 and 76 normally keeps the control valve 15 centered in the hold position H, isolating the source connections 10 and 11 from the motor 2. The service line 21 leading to the rod end of the motor 2 is therefore blocked by the control valve 15 in its hold position H. The valved vent line 56 is kept in valve closed condition owing to the normal position 60N assumed by the vent valve; so pressure entering through the orifice 55 into the closed vent chamber 54 holds the valve element of check valve 42 hydraulically on its seat, with no load pressure from load supporting chamber 5 being imposed in flexible line 22 which, along with the control valve 15, is thus isolated from being subjected to steady high pressure.

RAISE OPERATION R

The cancelling valve 34 and its posterior companion vent valve in the valved vent line 56 remain undisturbed throughout the operation.

The pumped output flowing from the source connection 11 is directed by the operator who, causing the valve 15 to be depressed into raise position R, directs the flow of pumped fluid into the valve connected end 26 of the flexible hose line 22, thence through the line 22 unseating the check valve element 57, and finally through the load connected end 29 of the line 22 into the load supporting chamber 5 of motor 2. The piston 4 elevates, raising the load 9 and reducing the volume of rod end chamber 6 so that return fluid flows through the service line 21, the valve 15 in its R position, thence through the source connection 10 into reservoir tank 13T.

The rising load 9 continues until the operator releases the handle 68 so that the self-centering valve 15 restores itself to position H; motion stops, with the valve 42 reseating and holding the load 9 at the elevation reached.

LOWER OPERATION L

The cancelling valve 34 remains undisturbed.

However, the vent valve, here assigned the general reference numeral 90 apurpose, is forthwith operated into the venting position 62V. This valve operation is caused by the connections 66 of the motion reversing mechanism 64 when they in turn are actuated by the control valve 15 taking the load lower position L thereof.

It is in order at this point to explain that the same valve 90 in the same environment for the same purpose is shown identified by the same general reference numeral 90 in U.S. Pat. Nos. 3,805,678, 3,906,840, 4,006,667, 4,194,532 and 4,204,459, and no claim is here made of inventing the valve 90 per se.

Because in its undisturbed normal position 37N, the cancelling valve 34 intercommunicates the vent chamber 54 and the vent valve 90, the latter in operating in its venting position as just described 62V vents the chamber 54 so that the pressure movable shoulder 53 holds the check valve element 50 open, for open communication from the load supporting chamber 5 with discharge flow in the path through the load connected end 29, the flexible line 22, the valve connected end 26 of the latter, and through the control valve 15 in its load lower position L thence into the reservoir tank 13T. The supply connection 11 on the other hand directs pumped flow through the service line 21 thence into the rod end chamber 6 of the motor 2 consistent with the ongoing action of lowering the load 9.

The load bearing piston 4 moves downwardly in the motor 2 until stopped by either normal stopping or emergency stopping now to be explained.

NORMAL STOPPING

Figure 2:
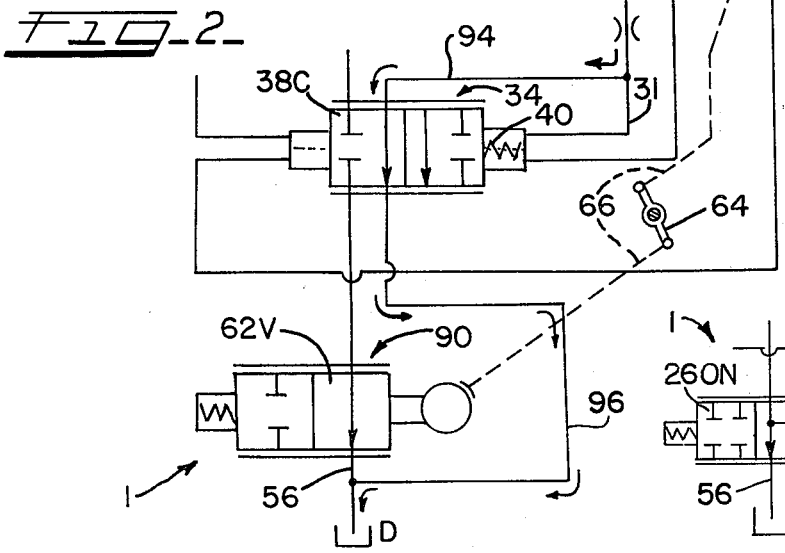
FIG. 2 is a schematic diagram of a number of the valves of FIG. 1, shifted into emergency operating position.
Figure 5:
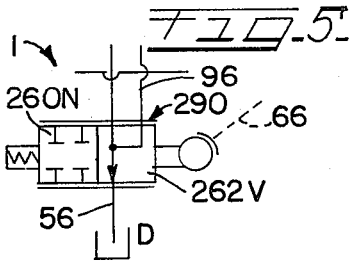

If it were only the case that the cancelling valve 34, in the way it is shown in normal position 37N in FIG. 1, were shown in the same way in normal position in FIG. 2 which it is not, then the FIG. 2 showing would illustrate all valves properly set to be operated for normal stopping of a load being lowered. That is to say, the vent valve 90 is shown in FIG. 2 in its appropriate venting position 62V, the motion reversing mechanism 64 is shown in its appropriate, solid line vent valve shifting position, and the control valve 15 is shown in its appropriate lower position L, all perfectly consistent with lowering the load, not shown.

Release by the operator of the control valve operator's handle 68 allows immediate recentering of the valve 15 to position H and immediate restoration of the vent valve 90 to normal position 60N as shown in FIG. 1.

Forthwith, the check valve 42 isolates the flexible line 22 and valve 15 from the high load pressure, which has meantime entered through the orifice 55 and forced the pressure movable bottom end area 57 of the element 50 upwardly to seat the load check valve and stop the piston 4 from lowering the load 9 farther.

EMERGENCY STOPPING

If the flexible line 22 as shown in FIG. 1 fails at all, it will have failed with the vent valve 90 and the control valve 15 in their load lower position as shown in FIG. 2 as just described.

Again with reference to FIG. 1, the first orifice 24 and second orifice 28 are identical, with identical flow and Venturi characteristics. So, when compared by the cancelling valve 34, the flow causing a pressure drop across the upstream second orifice 28 and an equal flow causing an equal drop across the downstream first orifice 24 will create equal and opposite pressure differentials in the sides of the opposing servo chambers 32 and 33; the valve 34 being in a state of hydraulic balance, will therefore take its normal position 37N under the bias of the unopposed spring 40.

With reference diverted back to FIG. 2, a split hose or cut hose or otherwise failed hose allows the upstream pressure differential to exceed the downstream pressure differential because of fluid escaping to the outside rather than entering into the downstream orifice, not shown, undiminished; so the cancelling valve spring 40 is overcome as shown in FIG. 2 and the cancelling valve 34 in line 56 takes its cancelling position 38C overriding the open vent valve 90. The vent chamber 54 is no longer vented through line 56 and the check valve element 50 immediately seats in the load check valve 42. The valve 42 thus blocks off the load supporting chamber 5 from line 22 and hydraulically locks the load bearing motor 2.

Although flexible line rupture and the attendant spray of hot oil to the outside usually immediately make the operator cognizant of hose failure, his knowledge is not essential because the system 1 will afford to him automatic operation if he does not choose to superimpose his own manual operation.

AUTOMATIC OPERATION

In FIG. 1, orifice 28's downstream sensing line 31 which taps into the annular groove 47 is actually a small branch of a restricted flow line from the load supporting chamber 5 comprising a restriction section 92, a cancelling valve section 94, and a shunt section 95 around the vent valve 90 to drain D, all constituting a check valve bypass.

Hence the check valve bypass, during the emergency condition when its cancelling valve section 94 feeds through the cancelling valve which is in its cancelling position 38C, FIG. 2, exerts restraint on the load 9, not shown, and at the same time provides for the controlled descent thereof because of the restriction section 92 which in effect brings down the load to a safe rest on the ground.

Thus the operator who, whether by inaction or otherwise has the control valve 15 set in the load lower position L as shown in FIG. 2, can avail of a steady, fixed release of fluid from the load sustaining chamber 5 so that he can still bring down the load fully despite partial or total breakage of the flexible hose line 22, not shown. The bypass path for the controlled rate of flow is indicated by arrows alongside the respective sections 92, 94 and 96 to drain D. After the manner of a self-locking relay, the cancelling valve 34 insures continual flow through orifice 28 by holding the bypass open, and the continual flow insures that the valve 34 will stay in its cancelling mode 38C. In other words, once committed the load continues downwardly to ground, without overcontrol being possible for the machine driver who has no means of manual operation to stop it.

MANUAL OPERATION EMBODIMENT—FIG. 5

In order to arrest lowering motion of the load 9 in an emergency at any point after the cancelling valve 34 has taken its cancelling position 38C as shown in FIG. 2, the operator according to the embodiment of this figure can restore the control valve 15 to its hold position H from the lower position L as shown in FIG. 2; perforce, the vent valve 290 is manually shifted from the illustrated venting position 262V to the normal blocking position 260N.

So the immediately previously open shunt section 96 leading to drain D is closed by valve 290. Therefore the bypass is blocked off, stopping the ongoing flow through the second orifice 28 being afforded through the cancelling valve bypass, and allowing the cancelling valve 34 to be restored to its normal position 37N as shown in FIG. 1.

Also the blocking position 260N insures that the vent of the check valve is closed off, and the check valve element 50, not shown, will function in the way described as a self-energizing poppet valve to sustain itself in the fluid blocking position in the load connected end of the flexible line 22. Load descent is immediately fully arrested, for the reason that the hydraulically parallel escape paths for the high pressure of load sustaining chamber 5, not shown, are blocked off by the respective closed bypass and closed check valve 42, not shown.

For reasons believed obvious from the foregoing, the operator at will can restore the fixed rate, load lowering motion with a control valve L setting, can re-arrest lowering motion with another control valve H setting, and keep the cycle repeating by alternating between these two manual control valve settings.

MODIFIED EMBODIMENT

If the manual control valve 15 is converted into a piloted valve operated by a piloting valve which can be provided under the control of the operator, the system of FIGS. 1 and 2 as modified will operate essentially the same, although piloting apparatus as appropriate is required to be added and also a source of piloting fluid.

Such modification has certain advantages despite the added expense because the control valve 15 can be located hydraulically much nearer the motor 2 with the effect of appreciably shortened hydraulic main line circuits.

FULLY PILOTED MODIFICATION—FIGS. 3, 4

In this alternate embodiment, identical elements are identified with the same reference numerals as in the preceding embodiments; so as before, the downstream sensing line 31 for second orifice 28 continues as a minor branch of the main bypass with the latter's sections 92, 94, and 96 leading to drain around the load check valve 42, as made necessary after emergency closure of the latter.

However, the operator's handle 68, mechanical interconnections 66, and control valve 34 of FIGS. 1 and 2 and their function are replaced in system 1, respectively, by an operator operated pilot valve 168, by a pilot line 166, and by a piloted control valve 134 as these counterparts are shown in FIGS. 3 and 4.

In operation in absence of a signal from the operator-operated pilot valve 168, the control valve 115 retains its familiar hold position H so that the check valve 42 will respond in regular way to the high pressure of load supporting chamber 5 in motor 2, so as to seat itself. Thus the valve 42 relieves the flexible hose line 22 of high pressure and, more importantly, protects line 22 against excessive pressure resulting from the dynamic action of the load of the machine if the latter is moving over rough terrain.

In operation when a selectively made raise piloting signal emanates in the direction 180R from the pilot valve 168, the control valve 115 reacts according to the previous way in its raise position R to introduce fluid in a path of flow through the flexible line 22, the resulting unseated load check valve 42, thence into the chamber 5 at the high pressure end of motor 2.

The vent chamber in load check valve 42 which is behind the orificed valve element is prevented by the orificed valve element itself from hydraulically locking the valve element on its seat, and the load is readily hydraulically raised. With the rising load, the flow afforded from the motor 2 displaced from the low pressure end is from the rod end chamber 6, through the service line 21, control valve 115, thence through source connection 10 into reservoir tank 13T.

In operation when a lowering signal selectively emanates from the pilot valve 168 in the direction 182L, the cancelling valve 134 remains in its normal position 137N communicating the load lower signal through the pilot line 166 to the chamber of a piloted vent valve 190. Forthwith, the vent valve 190 shifts, not mechanically as before but by piloting pressure, from its normal position 160N as shown in FIG. 3 into its venting position 162V as shown in FIG. 4.

So the thus vented load check valve 42, not shown in FIG. 4, is vented because of the valve-open condition of the valved vent line 56 and freely allows the piloted control valve 115 in position L to bring down the load as dictated by the pilot valve 168. Flow out of motor 2 is defined by the path of elements 5, 29, 22, 26, L, 10, and 13T; flow in is defined by the path of elements 11, L, 21, and 6.

In operation in the emergency of hose rupture during load lowering under the circumstances illustrated in FIG. 4, the cancelling valve 134 immediately reacts to the sensed counterbalancing pressure differentials no longer being equal and opposite; it shifts to the cancelling position 138C as shown in FIG. 4 because of the inherently greater pressure drop sensed across the upstream second orifice, not shown, where in said position 138C valve 134 does two things.

As in the preceding embodiment the cancelling valve 134 in the emergency causes, about the load check valve, not shown, the main bypass therearound to open, with the consecutive restriction and connected sections 92 and 94 thereof leading through the valve 134 to drain via the connected section 96 of the main bypass. And second, in slightly distinctive way, the cancelling valve 134 in its 138C position of FIG. 4 vents the vent valve pilot line 166 to drain D allowing the unopposed spring 172 of the vent valve 190 to restore the latter from the position as shown in FIG. 4 to the normal, vent line blocking position 160N to force closure in the desired way on the load check valve 42 to its closed position as illustrated in FIG. 3.

The resulting flow through the main bypass will be sufficient to sustain the pressure drop necessary across the upstream second orifice 28 and hydraulically hold the cancelling valve 134 in its cancelling position 138C as shown in FIG. 4. So the load check valve 42 will remain closed and the main bypass therearound will act restrictively to have the load come, at controlled rate, down to a stable resting place on the ground.

Or if the operator resets the pilot valve 168 in a hold position H producing no signal output, then the control valve 115 in assuming its own position H will in effect override the cancelling valve 134 and cause the unbypassed load check valve to lock the load upraised at whatever existing elevation it has.

No provision is made for the operator to override the descent and stop the downcoming load before it is resting at ground level.

Nevertheless the FIGS. 1, 2, and 3 embodiments can readily be adapted to a piloted system, with an override modification for stopping emergency descent.

OVERRIDE MODIFICATION FOR PILOTING—FIG. 6

In this piloting system 1 which incidentally embodies the override modification as well, the system 1 itself and other identical elements are identified with the same reference numerals as in the preceding embodiments; so as before in FIGS. 3 and 4 as described, the result of no signal, a raise signal 180R, and a load lower signal 182L from the operated pilot valve 168 is that a piloted main direction control valve 315 takes, respectively, a hold position H, a raise position R, and a lower position L for its intended purpose.

In turn for its own intended purpose, a piloted vent valve 390 goes into venting mode 362V incident to establishment of the load lower condition L whenever, due to the pressure signal 182L emanating equally thereto. And, until cancelled in its venting operation, the valve 390 lets the load check valve, not shown, unseat and stay open while fluid to the load supporting motor is operating same to lower the load.

In fail mode of the hose as sensed by the cancelling valve, not shown, the cancelling valve shifts and blocks off further venting fluid going in the line 56 to drain via the open vent valve 390; also the cancelling valve, simultaneously with closure of the unvented check valve, not shown, opens bypass flow leading through shunt section 96 thence into the open vent valve 390 and to drain D. The load continues down not at the operator's adjustable rate but at the automatically established rate of flow fixed by the highly restricted bypass.

As before, the operator can keep hands off the controls or operate the controls. If he keeps hands off, the downcoming load has the slow rate as automatically fixed.

Or if the operator resets the pilot valve 168 in a hold position H producing no signal output, then the piloted control valve 315 will assume its own hold position H and the vent valve 390 under spring action at 372 will assume the normal blocking position 360N.

In desired way, the unbypassed unvented load check valve, not shown, will stop the load upraised at whatever existing elevation it has, the bypassing of the load check valve will stop, and the cancelling valve, not shown, will be restored automatically from the fail mode or cancelling position to the normal position.

For further lowering, the automatic, fixed rate, load descent will go into effect as before to complete the cycle, immediately the operator sets pilot valve 168, FIG. 6, to L position producing signal 182L.

The cycle is then repeated.

It is apparent my invention, in its application as here illustrated to one jack, is equally applicable to systems with more than one jack, e.g., scraper bowls, wherein existing features are in no way sacrificed such as positive leakage control and isolation of the hose from sustained high pressure and from dynamically induced excessive pressure, and yet wherein I afford additionally automatic hydraulic load restraint in emergencies, either with the load fully restrained where it stays suspended against ground impact, or with the load automatically lowered to ground level by resting it on the ground so gradually that the impact with the ground is barely perceptible.

While leak detection is shown in the drawings to be done internally and indirectly by circuits within the hydraulic system, it is evident that my invention is equally applicable to oil sensing detectors strategically spotted outside the hoses and effective for leak detection directly.

Variations within the spirit and scope of the invention described are equally comprehended by the foregoing description.

What is claimed is:

1. In a fluid circuit system comprising a fluid motor (2) for raising and supporting a load having a load supporting chamber (5) in the motor, a master directional control valve (15) for selectively communicating pressurized fluid between a pressure fluid source (10,11) and said motor in correspondence with raise, lower, and load hold positions of the valve first named, and a second load check (42) valve hydraulically disposed between the first named valve and said motor for affording free flow of fluid from the first named valve to said motor and having a normal fluid blocking position for blocking flow of fluid from said motor to the first named valve, the improved combination with the first (15) and second (42) valves of:

service connections including a flexible transfer line (22) to carry the flow afforded by the first named valve between it and the second valve and loaded motor and essential thereto in raising, lowering, and holding the load;

said second valve having a control chamber (54) which, when vented, effects opening of said second valve to afford a routing of fluid of said load supporting chamber for its flow to and thru the flexible transfer line and which includes restriction means (55) in communication with said load supporting chamber, and said second valve being responsive to fluid pressure in said load supporting chamber to bias said second valve to said fluid blocking position thereby obstructing all flow to the flexible transfer line; and means (34) connected to said transfer line responsive to a flow characteristic attendant with line rupture to cancel venting of said control chamber for affording fluid biasing the second valve to said fluid blocking position.

2. In a fluid circuit system comprising a fluid motor (2) for raising and supporting a load having a load supporting chamber (5) in the motor, a master directional control valve (15) for selectively communicating pressurized fluid between a pressure fluid source (10,11) and said motor in correspondence with raise, lower, and load hold positions of the valve first named, and a second load check valve (42) hydraulically disposed between the first named valve and said motor for affording free flow of fluid from the first named valve to said motor and having a normal fluid blocking position for stopping flow from said motor to the first named valve, the improved combination with the first (15) and second (42) valves of:

service connections including a flexible transfer line (22) to carry the flow afforded by the first named valve between it and the second valve and loaded motor and essential thereto in raising, lowering, and holding the load;

said second valve having a control chamber (54) which, when vented, effects opening of said second valve to afford flow of fluid from said load supporting chamber into and through the transfer line and which includes restriction means (55) in communication with said load supporting chamber, and said second valve being responsive to fluid pressure in said load supporting chamber to bias said second valve to said fluid blocking position to block fluid delivered by the second valve into the transfer line for stopping flow from said motor to the first named valve;

cancelling valve means (34) connected to control a vent line (56) on the second valve effective to cancel venting of said control chamber;

an interposed first flow orifice (24) creating a pressure drop in the fluid being delivered by the transfer line into the first named valve and an interposed second flow orifice (28) creating a pressure drop in the fluid being delivered by the load supporting chamber and the second valve into the transfer line; and comparator means (32,33) connected to the cancelling valve means responsive to the drop across the second flow orifice exceeding the drop across the first flow orifice, to cancel venting of said control chamber for affording fluid biasing the second valve to said fluid blocking position to block fluid delivered by the second valve into the transfer line.

3. The invention of claim 1 or 2, characterized by:

said vent cancelling means (34) having a connection to the load supporting chamber effective while cancelling venting of said control chamber to open to drain a restricted bypass (92) around the fluid blocking positioned second valve so as to afford a sustained release of fluid therearound from the load supporting chamber at a controlled rate of flow.

4. The invention of claim 2, characterized by:

said cancelling valve means (34) being connected to override a vent valve (90) connected in said vent line (56) active to vent said control chamber, and effective to cancel the vent valve venting action.

5. A fluid circuit system comprising:

a fluid motor (2) for raising and supporting a load having a load supporting chamber (5) in the motor;

a master directional control valve (15) for selectively communicating pressurized fluid between a pressure fluid source (10,11) and said motor in correspondence with raise, lower, and load hold positions of the valve;

fluid communication means to carry the flow afforded by the valve between it and loaded motor comprising a flexible transfer line (22) having a load connected end (29) and a master valve connected end (26) and essential in raising, lowering, and holding the load;

a load check valve (42) hydraulically interposed at the load connected end of the flexible transfer line for affording free flow of fluid therethrough to the motor and having a normal fluid blocking position (FIG. 1) for blocking flow of the motor fluid into the flexible transfer line and to the master valve;

said check valve having a control chamber (54) including restriction means (55) in communication with said load supporting chamber, and said check valve being responsive to fluid pressure in said load supporting chamber to bias said check valve to said fluid blocking position;

valved vent line means (56) operative in a valve-open position to vent said control chamber to effect opening of said check valve to afford flow of fluid from said load supporting chamber; and line-flow comparator means (34) connected to the valved vent line means effective in the valve-open condition of same for blocking same to close off the control chamber for affording fluid biasing the check valve to said fluid blocking position (FIG. 1) automatically in response to flexible-line-flow in the load connected end (29) exceeding flow in the master valve connected end (26).

6. The invention of claim 5, characterized by:

said comparator means (34) having a connection to said load connected end (29) effective while automatically closing off the check valve control chamber (54) to open to drain a restricted bypass (92) around the check valve so as to afford a sustained release of fluid through said load connected end at controlled rate of flow.

7. Circuit operation of an hydraulic fluid system comprising a fluid motor (2) for raising and supporting a load having a load supporting chamber (5) in the motor, a master directional control valve (15) for selectively communicating pressure fluid between a pressure fluid source (10,11) and said motor in correspondence with raise, lower, and load hold positions of the valve first named, and a second load check valve (42) hydraulically disposed between the first named valve and said motor for affording free flow of fluid from the first named valve to said motor and having a normal fluid blocking position (FIG. 1) for stopping flow from said motor to the first named valve, service connections including a flexible transfer line (22) to carry the flow afforded by the first named valve between it and the second valve and loaded motor and essential thereto in raising, lowering, and holding the load of the latter, said second valve capable of opening to afford flow of fluid from said load supporting chamber into and thru the transfer line, said second valve subject under bias to take a fluid blocking position (FIG. 1) to block fluid delivered by the second valve into the transfer line for stopping flow from said motor to the first named valve, said circuit operation comprising the improved steps of:

sensing the flow rate being delivered by the transfer line into the first named valve as a first differential (35,36) in comparison to a sensed second differential (30,31) from the flow rate being delivered by the load supporting chamber and second valve into the transfer line; and biasing the second valve to the fluid blocking position (FIG. 1) when the second flow rate differential sensed exceeds the first flow rate differential sensed.

8. The invention of claim 7, characterized by the further step of:

restrictively bypassing (92) the blocking second valve so as to afford a sustained release of fluid therearound from the load sustaining chamber to drain at controlled rate of flow.

9. Method of fluid control at adjustable and automatically fixed rates of flow to adjust a load being hydraulically sustained, comprising the steps of:

directing in a path pressure fluid applied in an adjustable flow rate at a pressure application-exhaust point through an open poppet-type valve to a high pressure load supporting chamber to adjustably raise a load;

releasing fluid at an adjustable rate at said point in a reverse flow path leading from said load supporting chamber and through the open poppet-type valve to adjustably lower the load;

sensing when the flow rate of fluid released through the poppet-type valve becomes excessive over the ongoing flow rate of the released fluid at said point;

automatically closing the poppet-type valve when the just described released fluid flow rate as sensed becomes excessive; and simultaneously automatically releasing the fluid of said load supporting chamber in a bypass to drain at a fixed highly restricted rate of flow.

10. Circuit operation of an hydraulic fluid system comprising a fluid motor (2) for raising and supporting a load having a load supporting chamber (5) in the motor, a master directional control valve (15) for selectively communicating fluid between a pressure fluid source (10,11) and said motor in correspondence with raise, lower, and load hold positions of the valve first named, and a second load check valve (42) hydraulically disposed between the first named valve and said motor for affording free flow of fluid from the first named valve to said motor and having a normal fluid blocking position (FIG. 1) for stopping flow from said motor to the first named valve, service connections including a flexible transfer line (22) to carry the flow afforded by the first named valve between it and the second valve and loaded motor and essential thereto in raising, lowering, and holding the load of the latter, said second valve having a control chamber (54) which, when vented, effects opening of said second valve to afford flow of fluid from said load supporting chamber into and through the transfer line and which includes restriction means (55) in communication with said load supporting chamber, and said second valve being responsive to fluid pressure in said load supporting chamber to bias said second valve to said fluid blocking position (FIG. 1) to block fluid delivered by the second valve into the transfer line for stopping flow from said motor to the first named valve, said circuit operation comprising the improved steps of:

sensing the flow rate being delivered by the transfer line into the first named valve as a first pressure differential drop (36,35) in comparison to a sensed second pressure differential drop (30,31) from the flow rate being delivered by the load supporting chamber and second valve into the transfer line; and cancelling all venting of the control chamber for affording fluid biasing the second valve to the fluid blocking position (FIG. 1) when the second flow rate pressure differential drop sensed exceeds the first flow rate pressure differential drop sensed.

11. The invention of claim 10, characterized by the further step of:

simultaneously, while fluid-biasing the second valve to the fluid blocking position (FIG. 1), opening a restricted bypass around the blocking second valve so as to afford a sustained release of fluid therearound from the load sustaining chamber (5) at controlled rate of flow.

12. The invention of claim 11 characterized by the step, at will, of:

closing off said bypass (92) while continuing to retain said control chamber unvented.

* * * * *